US008911527B2

(12) United States Patent
Ferrer et al.

(10) Patent No.: US 8,911,527 B2
(45) Date of Patent: Dec. 16, 2014

(54) HOMOGENIZATION OF MARTENSITIC STAINLESS STEEL AFTER REMELTING UNDER A LAYER OF SLAG

(75) Inventors: Laurent Ferrer, Lieusaint (FR); Patrick Philipson, Bois le Roi (FR)

(73) Assignee: SNECMA, Paris (FR)

( * ) Notice: Subject to any disclaimer, the term of this patent is extended or adjusted under 35 U.S.C. 154(b) by 94 days.

(21) Appl. No.: 13/501,377

(22) PCT Filed: Oct. 11, 2010

(86) PCT No.: PCT/FR2010/052140

§ 371 (c)(1), (2), (4) Date: Jun. 22, 2012

(87) PCT Pub. No.: WO2011/045513

PCT Pub. Date: Apr. 21, 2011

(65) Prior Publication Data

US 2012/0260771 A1 Oct. 18, 2012

(30) Foreign Application Priority Data

Oct. 12, 2009 (FR) ..... 09 57108

(51) Int. Cl.
*C22B 9/00* (2006.01)
*C21D 6/00* (2006.01)
*C22B 9/18* (2006.01)

(52) U.S. Cl.
CPC . *C21D 6/002* (2013.01); *C22B 9/18* (2013.01); *C21D 6/004* (2013.01)
USPC ..... 75/10.25; 148/548; 148/622

(58) Field of Classification Search
USPC ..... 75/10.25; 148/548, 622
See application file for complete search history.

(56) References Cited

U.S. PATENT DOCUMENTS 3,768,996 A * 10/1973 Metz ..... 75/310
4,061,493 A * 12/1977 Jaeger ..... 75/10.19

(Continued)

FOREIGN PATENT DOCUMENTS

EP 0 577 997 1/1994
JP 52-120208 * 10/1977

(Continued)

OTHER PUBLICATIONS

Maraging steel. (n.d.). Dictionary.com Unabridged. Retrieved Sep. 24, 2013, from Dictionary.com website: http://dictionary.reference.com/browse/maraging steel.*

(Continued)

*Primary Examiner* — George Wyszomierski
*Assistant Examiner* — Tima M McGuthry Banks
(74) *Attorney, Agent, or Firm* — Oblon, Spivak, McClelland, Maier & Neustadt, L.L.P.

(57) ABSTRACT

A method of fabricating a stainless martensitic steel includes a step of electroslag remelting of an ingot of the steel then a step of cooling the ingot. Before the skin temperature of the ingot falls below the martensitic transformation temperature Ms of the steel, the ingot from electroslag remelting is placed in a furnace with an initial temperature $T_0$ that is then higher than the pearlitic transformation completion temperature on cooling, Ar1, of the steel, the ingot undergoing a homogenization treatment in the furnace for at least a holding time t after which the temperature of the coldest point of the ingot has reached a homogenization temperature T, the holding time t being equal to at least one hour, with the homogenization temperature T being in the range approximately 900° C. to the burning temperature of the steel.

8 Claims, 2 Drawing Sheets

(56) References Cited

U.S. PATENT DOCUMENTS

| | | | | |
|---|---|---|---|---|
| 4,832,909 | A * | 5/1989 | Schmidt et al. | 420/95 |
| 5,524,019 | A | 6/1996 | Takenouchi et al. | |
| 7,445,678 | B2 * | 11/2008 | Mishima et al. | 148/221 |
| 2008/0314480 | A1 | 12/2008 | Wright et al. | |
| 2009/0196784 | A1 | 8/2009 | Fedchun et al. | |
| 2010/0308505 | A1 * | 12/2010 | Welch et al. | 264/337 |
| 2011/0206503 | A1 | 8/2011 | Ferrer et al. | |
| 2011/0211945 | A1 | 9/2011 | Ferrer et al. | |
| 2011/0268566 | A1 | 11/2011 | Ferrer et al. | |
| 2012/0132326 | A1 | 5/2012 | Ferrer et al. | |

FOREIGN PATENT DOCUMENTS

| | | |
|---|---|---|
| JP | 52-143907 | * 11/1977 |
| JP | 03-124304 | 5/1991 |
| JP | 07-003333 | 1/1995 |
| JP | 08-100223 | 4/1996 |
| JP | 2003-515672 | 5/2003 |
| WO | 01/40526 | 6/2001 |
| WO | 2006 081401 | 8/2006 |

OTHER PUBLICATIONS

U.S. Appl. No. 13/382,052, filed Mar. 23, 2012, Ferrer.

U.S. Appl. No. 13/501,610, filed Apr. 12, 2012, Ferrer, et al.

U.S. Appl. No. 13/501,568, filed Apr. 12, 2012, Ferrer, et al.

International Search Report Issued Dec. 23, 2010 in PCT/FR10/52140 Filed Oct. 11, 2010.

Office Action issued in Japanese Patent Application No. 2012-533671 on May 13, 2014 (w/ English translation).

* cited by examiner

HOMOGENIZATION OF MARTENSITIC STAINLESS STEEL AFTER REMELTING UNDER A LAYER OF SLAG

BACKGROUND OF THE INVENTION

1. Field of the Invention

The present invention relates to a method of fabricating a stainless martensitic steel, comprising a step of electroslag remelting of an ingot of said steel then a step of cooling said ingot.

In the present invention, unless otherwise stated, the composition percentages are percentages by weight.

2. Description of the Related Art

A stainless martensitic steel is a steel with a chromium content of more than 10.5% and of a structure that is essentially martensitic.

It is important for the fatigue behavior of such a steel to be as good as possible so that the service life of parts produced from such a steel is maximized.

To this end, it is sought to improve the inclusion characteristics of the steel, i.e. to reduce the quantity of undesirable inclusions (certain alloy, oxide, carbide, and intermetallic compound phases) present in the steel. Such inclusions act as crack initiation sites that, under cyclic loading, result in premature failure of the steel.

Experimentally, a large dispersion is observed in the results of fatigue tests carried out on test specimens of that steel, i.e. for each level of fatigue loading under imposed deformation, the service life (corresponding to the number of cycles resulting in breaking of a fatigue specimen in that steel) varies over a wide range. Inclusions are responsible for the minimum values, in the statistical sense, for the fatigue service life of the steel (low values of the range).

In order to reduce that dispersion in fatigue behavior, i.e. in order to raise those low values, and also to enhance the mean fatigue behavior value, it is necessary to improve the inclusion characteristics of the steel. The electroslag remelting technique, ESR, is known. In that technique, the steel ingot is placed in a crucible into which a slag (mixture of minerals, for example lime, fluorides, magnesia, alumina, calcite) is poured such that the lower end of the ingot is immersed in the slag. Next, an electric current is passed through the ingot, which acts as an electrode. That current is sufficiently high to heat and liquefy the slag and to heat the lower end of the steel electrode. The lower end of that electrode is in contact with the slag, and so it melts and passes through the slag in the form of fine droplets, and then solidifies below the layer of slag, which floats, to form a new ingot that therefore grows gradually. The slag acts, inter alia, as a filter that extracts the inclusions from the steel droplets, such that the steel of that new ingot located below the layer of slag contains fewer inclusions than the initial ingot (electrode). That operation is carried out at atmospheric pressure and in air.

Although the ESR technique can reduce the dispersion in the fatigue behavior of stainless martensitic steels by eliminating inclusions, that dispersion is still too large in terms of the service life of the parts.

Non-destructive testing using ultrasound carried out by the inventors has shown that said steels include practically no known hydrogen defects (flakes).

The dispersion of the fatigue behavior results, specifically the low end values of the range of results, is thus due to another undesirable mechanism of premature initiation of cracks in the steel, which results in premature fatigue breaking.

BRIEF SUMMARY OF THE INVENTION

The aim of the present invention is to provide a fabrication method that can raise these low values and thus reduce the dispersion of the fatigue behavior of stainless martensitic steels and enhance its mean fatigue behavior.

This aim is achieved in that before the temperature of the skin of said ingot falls below the martensitic transformation temperature Ms of the steel, the ingot from electroslag remelting is placed in a furnace in which the initial temperature $T_0$ is then greater than the pearlite transformation completion temperature on cooling, Ar1, of said steel, said ingot undergoing a homogenization treatment in said furnace for at least a holding time t after which the temperature of the coldest point of the ingot has reached a homogenization temperature T, said holding time t being equal to at least one hour, with the homogenization temperature T being in the range approximately 900° C. to the burning temperature of the steel.

These means reduce the formation of gas phases of microscopic dimensions (not detectable by industrial non-destructive testing means) constituted by light elements within the steel, and thus avoid premature initiation of cracks from said microscopic phases, which give rise to premature failure of the steel under fatigue.

BRIEF DESCRIPTION OF THE SEVERAL VIEWS OF THE DRAWINGS

The invention and its advantages can be better understood from the following detailed description of an implementation shown by way of non-limiting example. The description makes reference to the accompanying drawings in which.

DETAILED DESCRIPTION OF THE INVENTION

Figure 3:
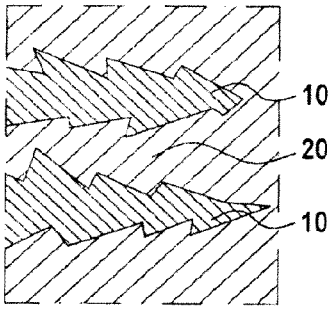
FIG. 3 is a diagram illustrating dendrites and interdendritic regions.

During the ESR process, the steel that has been filtered by the slag cools and gradually solidifies to form an ingot. This solidification occurs during cooling and involves the growth of dendrites 10, as illustrated in FIG. 3. In agreement with the phase diagram for stainless martensitic steels, the dendrites 10, corresponding to the first solidified grains, are by definition richer in alphagenic elements, while the interdendritic regions 20 are richer in gammagenic elements (application of the known lever rule for phase diagrams). An alphagenic element is an element that favors a ferritic type structure (structures that are more stable at low temperatures: bainite, ferrite-pearlite, martensite). A gammagenic element is an element that favors an austenitic structure (a structure that is stable at high temperatures). Thus, segregation occurs between the dendrites 10 and the interdendritic regions 20.

This local segregation in the chemical composition is then retained throughout fabrication, even during subsequent hot forming operations. Thus, this segregation is found both in the as-solidified ingot and in the subsequently deformed ingot.

Figure 5:
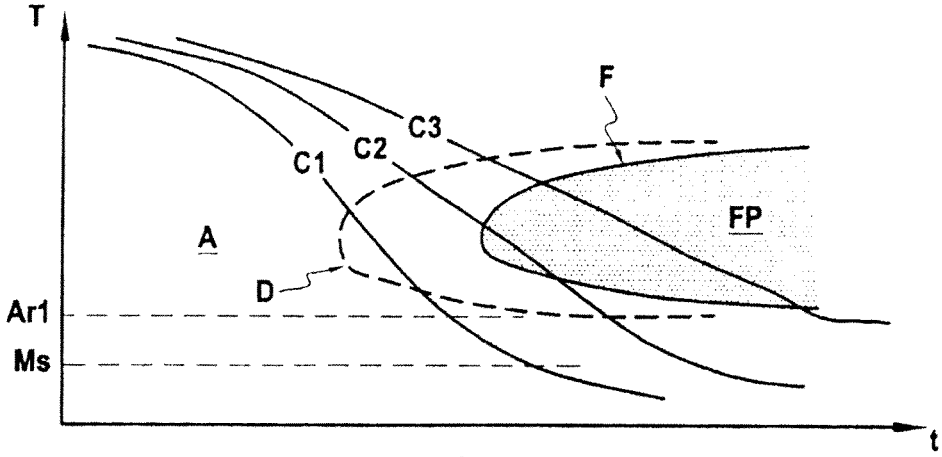
FIG. 5 is a time-temperature diagram of cooling curves for a region that is richer in alphagenic elements and less rich in gammagenic elements.
Figure 6:
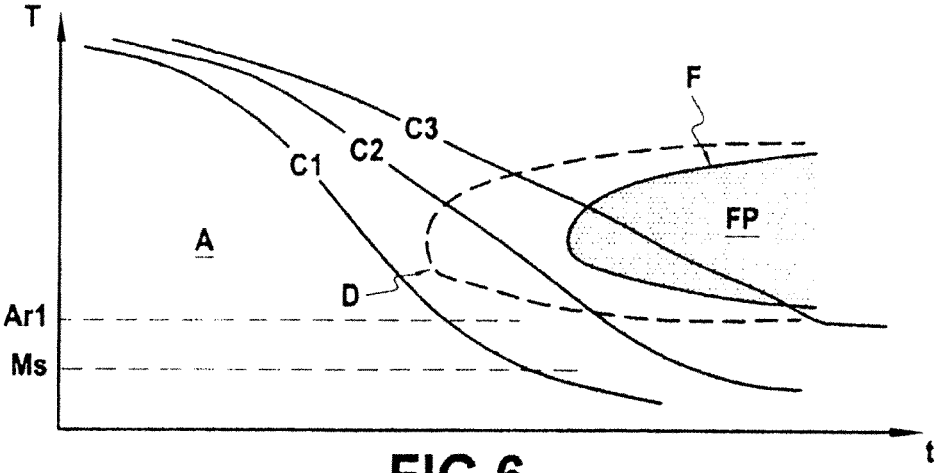
FIG. 6 is a time-temperature diagram of cooling curves for a region that is less rich in alphagenic elements and richer in gammagenic elements.

The inventors have been able to show that the results depend on the diameter of the ingot derived directly from the ESR crucible or from the ingot after hot deformation. This observation can be explained by the fact that the cooling rates decrease with increasing diameter. FIGS. 5 and 6 illustrate different scenarios that may occur.

FIG. 5 is a known temperature (T)-time (t) diagram for a region that is richer in alphagenic elements and less rich in gammagenic elements, such as dendrites 10. The curves D and F mark the onset and the end of the transformation from austenite (region A) to the ferritic-pearlitic structure (region FP). This transformation occurs, partially or fully, when the cooling curve that the ingot follows passes respectively into the region between the curves D and F or also into the region FP. It does not occur when the cooling curve is located entirely in the region A.

FIG. 6 is an equivalent diagram for a region that is richer in gammagenic elements and less rich in alphagenic elements, such as the interdendritic regions 20. It should be noted that compared with FIG. 5, curves D and F are shifted towards the right, i.e. the ingot needs to be cooled more slowly in order to obtain a ferritic-pearlitic structure.

Each of FIGS. 5 and 6 shows three cooling curves from an austenitic temperature, corresponding to three cooling rates: rapid (curve C1), medium (curve C2), slow (curve C3).

During cooling, the temperature starts to decrease from an austenitic temperature. In air, for the diameters of interest, the cooling rates of the surface and of the core of the ingot are very close. The only difference arises from the fact that the surface temperature is lower than that of the core since the surface cools before the core.

With cooling more rapid than the rapid cooling (curve C1) (FIGS. 5 and 6), ferritic-pearlitic transformations do not occur.

With rapid cooling in accordance with curve C1, the transformations are only partial, solely in the dendrites (FIG. 5).

With medium cooling in accordance with curve C2, the transformations are only partial in the interdendritic spaces 20 (FIG. 6) and quasi-complete in the dendrites 10 (FIG. 5).

With slow cooling in accordance with curve C3 and for even slower cooling, the transformations are almost complete both in the interdendritic spaces 20 and in the dendrites 10.

With rapid (C1) or medium (C2) cooling, cohabitation occurs to a greater or lesser extent between the ferritic regions and the austenitic regions.

Once the material has solidified, the dendrites 10 are initially transformed into ferritic structures during cooling (by passing through the curves D and F of FIG. 5). However, the interdendritic regions 20 are either not transformed (in the event of rapid cooling in accordance with curve C1) or are subsequently transformed, in part or in full (in the event of medium cooling in accordance with curve C2 or slow cooling in accordance with curve C3), at lower temperatures (see FIG. 6).

The interdendritic regions 20 thus retain an austenitic structure for longer.

During said solid state cooling, a local structural heterogeneity exists with cohabitation of austenitic and ferritic type microstructures. Under these conditions, light elements (H, N, O), which are more soluble in the austenite than in the ferritic structures, have a tendency to become concentrated in the interdendritic regions 20. This concentration is increased by the larger quantity of gammagenic elements in the interdendritic regions 20. At temperatures of less than 300° C., the light elements diffuse only at extremely low rates and remain trapped in their region. After complete or partial transformation of the interdendritic zones 20 into a ferritic structure, the solubility limit of these gas phases is reached under certain concentration conditions and these gas phases form pockets of gas (or of a substance that is in a physical state that provides high malleability and incompressibility).

During the cooling stage, the larger the diameter of the ingot (or the subsequently deformed ingot) at the end of the ESR (or, more generally, the larger the maximum dimension of the ingot), or the lower the cooling rate of the ingot, the greater is the tendency for the light elements to diffuse from the dendrites 10 with a ferritic structure towards the interdendritic regions 20 with a completely or partially austenitic structure where they become concentrated during the period of cohabitation of ferritic and austenitic structures. The risk of the solubility of these light elements being locally exceeded in the interdendritic regions is accentuated. When the concentration of light elements exceeds this solubility, microscopic gas pockets containing said light elements then appear in the steel.

In addition, while cooling is finishing, the austenite of the interdendritic regions tends to be transformed locally into martensite when the temperature of the steel falls below the martensitic transformation temperature Ms, which is slightly above ambient temperature (FIGS. 5 and 6). However, martensite has a solubility threshold for light elements that is even lower than the other metallurgical structures and than austenite. Thus, more microscopic gas phases appear in the steel during this martensitic transformation.

During subsequent deformations that the steel undergoes during hot forming (for example forging), these phases flatten out into a sheet form.

Under fatigue loading, these sheets act as stress concentration sites that are responsible for premature initiation of cracks by reducing the energy necessary for crack initiation. This then results in premature failure of the steel, which gives rise to the low values in the fatigue behavior results.

Figure 4:
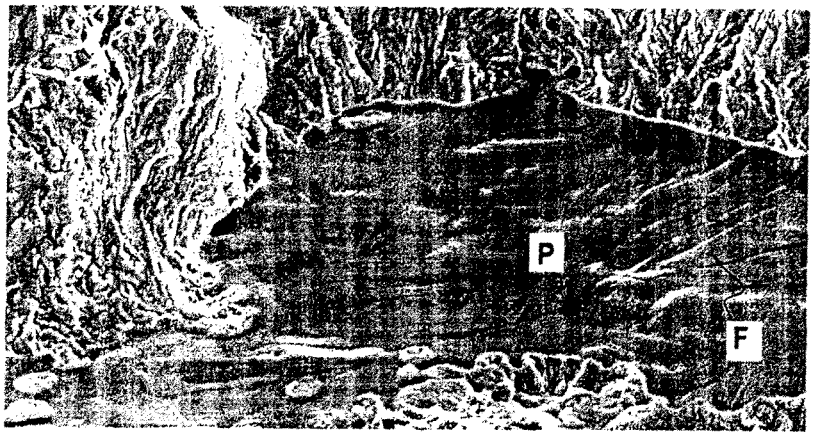
FIG. 4 is a photograph taken using an electron microscope of a fracture surface after fatigue, showing the gas phase that initiated that fracture.

These conclusions have been corroborated by the inventors' observations, as shown in the electron microscope photograph of FIG. 4.

On this photograph of a fracture surface of a stainless martensitic steel, a substantially globular zone P can be seen from which cracks F radiate. This zone P is the footprint of the gas phase constituted by light elements that is at the origin of the formation of these cracks F that, by propagating and agglomerating, have created a macroscopic fracture zone.

The inventors carried out tests on stainless martensitic steels and found that when, immediately after the ESR step, a particular homogenization treatment is carried out on the ingot from the ESR crucible, the formation of light element gas phases is reduced.

Diffusion of alloying elements from zones with a high concentration towards zones with a low concentration allows the intensity of segregations into alphagenic elements in the dendrites 10 to be reduced and allows the intensity of segregations into gammagenic elements in the interdendritic regions 20 to be reduced. Reducing the intensity of segregations into these gammagenic elements has the following consequences: a smaller shift to the right of curves D and F for transformation into a ferritic-pearlitic structure (FIG. 6), a smaller structural difference between the dendrites 10 and the interdendritic regions 20, and a smaller difference in solubility of light elements (H, N, O) between the dendrites and the interdendritic regions, resulting in better homogeneity in terms of structure (less cohabitation of austenitic and ferritic structures) and of chemical composition, including light elements.

Further, the homogenization treatment also involves homogenization of the martensitic transformation temperature Ms.

When the temperature of the steel is at a temperature of more than 300° C., diffusion of the alloying elements is far from being negligible. In addition, if the temperature gradient can produce a surface that is hotter than the center of the ingot, as with the pickup conditions proposed by the inventors, the light elements diffuse towards the surface, reducing their overall content in the steel.

Regarding the particular features of the homogenization treatment, the inventors have discovered that satisfactory results are obtained when the ingot undergoes a homogenization treatment in the furnace for a holding time t after which the temperature of the coldest point of said ingot has reached a homogenization temperature T, this time t being equal to at least one hour, with the homogenization temperature T varying between a temperature $T_{min}$ and the burning temperature of that steel.

The temperature $T_{min}$ is approximately equal to 900° C. The burning temperature of a steel is defined as the temperature, in the as-solid state, at which the grain boundaries in the steel are transformed (or even are liquefied), and is greater than $T_{min}$. This holding time t for the steel in the furnace thus varies inversely with said homogenization temperature T.

As an example, with a Z12CNDV12 stainless martensitic steel (AFNOR standard) used by the inventors in the tests, the homogenization temperature T is 950° C., and the corresponding holding time t is equal to 70 hours. When the homogenization temperature T is 1250° C., which is slightly below the burning temperature, then the corresponding holding time t is equal to 10 hours.

As an example, the homogenization temperature T is selected from a range selected from the group comprising the following ranges: 950° C. to 1270° C., 980° C. to 1250° C. and 1000° C. to 1200° C.

As an example, the minimum holding time t is selected to be in a range selected from the group comprising the following ranges: 1 hour to 70 hours, 10 hours to 30 hours and 30 hours to 150 hours.

Further, the inventors have discovered that satisfactory results are obtained when the ingot from the ESR crucible is placed in a furnace with an initial temperature $T_0$ that is higher than the pearlitic transformation completion temperature on cooling, Ar1, of that steel, and when the skin temperature of that ingot is kept higher than the martensitic transformation temperature Ms of that steel.

When the initial temperature $T_0$ of the furnace is less than the homogenization temperature T, after the ingot has been placed in said furnace, the temperature of the furnace is increased to a temperature that is at least equal to the homogenization temperature. Thus, during this temperature increase, a homogeneous austenitic structure tends to be produced in order to homogenize the hydrogen content, and a temperature gradient that increases from the center of the part towards the surface also tends to be produced. The temperature at the center of the ingot thus stays lower than the temperature of the skin of the ingot during the entire temperature increase period. This therefore enables general and more effective degassing of the ingot.

Alternatively, the initial temperature $T_0$ of the furnace may be higher than the homogenization temperature, and under such circumstances the temperature of the furnace is simply held above this homogenization temperature.

The inventors have established that the homogenization treatment is particularly necessary when:

- the maximum dimension of the ingot is less than approximately 910 mm [millimeter], and the H content of the ingot before electroslag remelting is more than 10 ppm [parts per million]; and
- the maximum dimension of the ingot is more than approximately 910 mm and the minimum dimension of the ingot is less than approximately 1500 mm, and the H content of the ingot before electroslag remelting is more than 3 ppm; and
- the minimum dimension of the ingot is more than 1500 mm and the H content of the ingot before electroslag remelting is more than 10 ppm.

The maximum dimension of the ingot is that of its measurements in its bulkiest portion and the minimum dimension of the ingot is that of its measurements in its least bulky portion:

- immediately after electroslag remelting when the ingot does not undergo hot forming before its subsequent cooling;
- when the ingot undergoes hot forming after electroslag remelting, just before its subsequent cooling.

As indicated above, the inventors have established that the concentrations of light elements may be higher (more than 10 ppm) when the minimum dimension of the ingot or of the deformed ingot is greater than a high dimensional threshold (in fact 1500 mm). The explanation for the existence of a high threshold (1500 mm) for the minimum dimension of the ingot is as follows: when the minimum dimension of the ingot is higher than this threshold, the situation approaches the slow cooling of curve C3 in which there is almost no structural difference between the dendrites and the interdendritic regions during cooling. In addition, the cooling rate is sufficiently low for the temperature to be substantially homogeneous between the skin and the core of the ingot, and thus for diffusion of the light elements towards the surface to be facilitated, allowing more degassing. In contrast, when the minimum dimension of the ingot is below this threshold, then during cooling, the ingot core is substantially hotter than its surface, which promotes the diffusion of the light elements towards the core, retarding degassing.

Further, it is preferable for the slag to be dehydrated before it is used in the ESR crucible, since this minimizes the quantity of hydrogen present in the slag, and thus minimizes the quantity of hydrogen that could pass from the slag to the ingot during the ESR method.

The inventors have carried out tests on Z12CNDV12 steels produced using the method of the invention, i.e. with homogenization carried out immediately after removing the ingot from the ESR crucible, employing the following parameters:

- Test No 1: ingot skin temperature 250° C., placed in furnace at 400° C., raising temperature of furnace to homogenization temperature of 1250° C., metallurgical holding (from the time that the coldest temperature of the ingot reaches the homogenization temperature) 75 h [hour], cooling to ambient temperature;
- Test No 2: ingot skin temperature 600° C., placed in furnace at 450° C., raising temperature of furnace to homogenization temperature of 1000° C., metallurgical holding (from the time that the coldest temperature of the ingot reaches the homogenization temperature) 120 h [hour], cooling to ambient temperature.

The results of these tests are presented below.

The composition of the Z12CNDV12 steels was as follows (DMD0242-20 standard, index E):

C (0.10% to 0.17%)-Si (<0.30%)-Mn (0.5% to 0.9%)-Cr (11% to 12.5%)-Ni (2% to 3%)-Mo (1.50% to 2.00%)-V (0.25% to 0.40%)-$N_2$ (0.010% to 0.050%)-Cu (<0.5%)-S (<0.015%)-P (<0.025%) and satisfying the criterion:

$$4.5 \leq (Cr-40.C-2.Mn-4.Ni+6.Si+4.Mo+11.V-30.N) < 9$$

The measured martensitic transformation temperature Ms was 220° C.

The quantity of hydrogen measured in the ingots before electroslag remelting varied in the range 3.5 ppm and 8.5 ppm.

Figure 1:
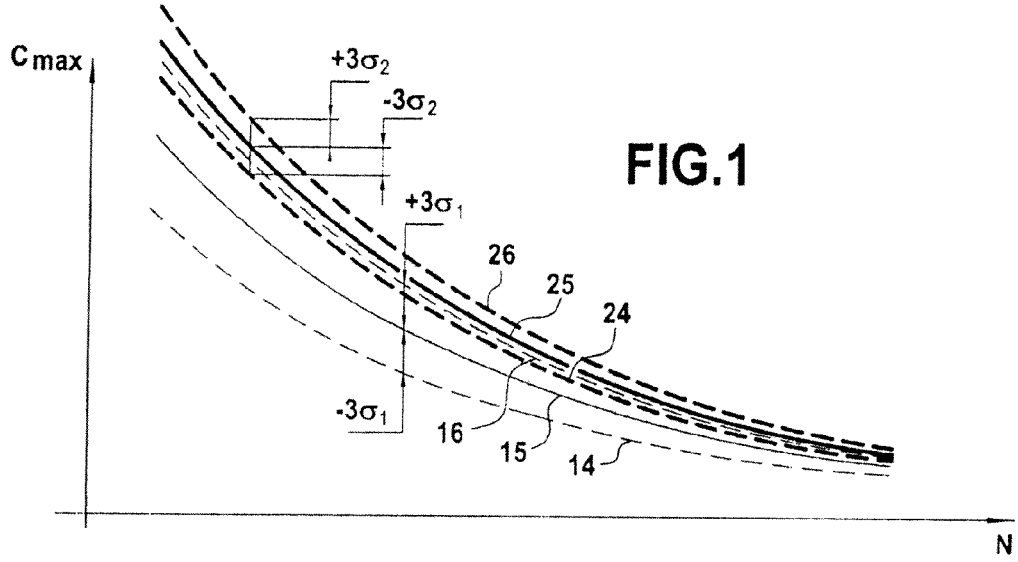
FIG. 1 compares the fatigue service life curves for a steel of the invention and a prior art steel.

FIG. 1 qualitatively shows the improvements brought about by the method of the invention. Experimentally, a value was obtained for the number N of cycles to breaking needed to break a steel specimen subjected to cyclic tensile loading as a function of the pseudo alternating stress C (the load on the specimen under imposed deformation, in accordance with Snecma standard DMC0401 used for these tests).

Figure 2:
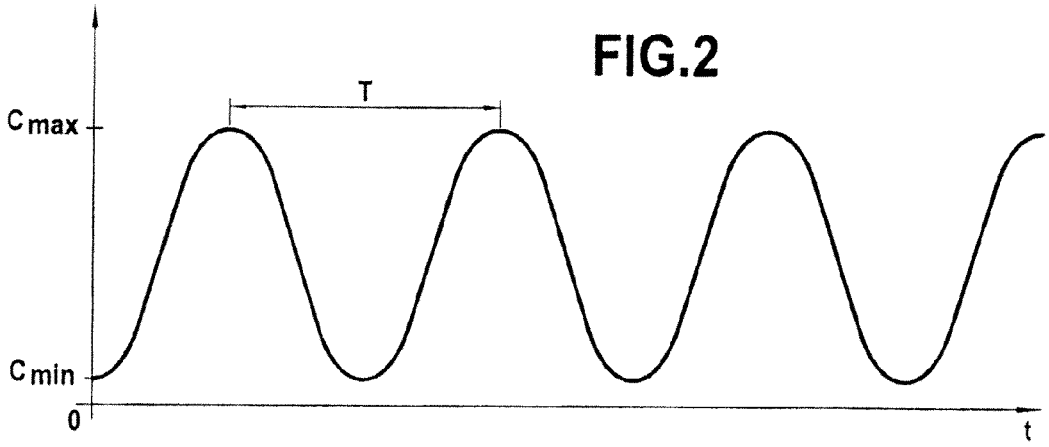
FIG. 2 shows a fatigue loading curve.

Such a cyclic loading is shown diagrammatically in FIG. 2. The period T represents one cycle. The stress changes between a maximum value $C_{max}$ and a minimum value $C_{min}$.

By fatigue testing a statistically sufficient number of specimens, the inventors obtained points N=f(C) from which they drew up a mean statistical C-N curve (stress C as a function of the number N of fatigue cycles). The standard deviations for the loads were than calculated for a given number of cycles.

In FIG. 1, the first curve 15 (narrow line) is (diagrammatically) the mean curve obtained for a steel produced in accordance with the prior art. This first mean C-N curve is between two curves 16 and 14 shown as narrow dashed lines. These curves 16 and 14 are located respectively at a distance of $+3\sigma_1$ and $-3\sigma_1$ from the first curve 15, $\sigma_1$ being the standard deviation of the distribution of the experimental points obtained during these fatigue tests; $\pm 3\sigma_2$ corresponds in statistics to a confidence interval of 99.7%. The distance between these two dashed line curves 14 and 16 is thus a measure of the dispersion of the results. The curve 14 is the limiting factor for the dimensions of a part.

In FIG. 1, the second curve 25 (thick line) is (diagrammatically) the mean curve obtained from the fatigue test results carried out on a steel produced in accordance with the invention under loading in accordance with FIG. 2. This second mean C-N curve lies between two curves 26 and 24 shown as thick dashed lines, located respectively at a distance of $+3\sigma_2$ and −3(2 from the second curve 25, (2 being the standard deviation of the experimental points obtained during these fatigue tests. The curve 24 is the limiting factor for the dimensions of a part.

It should be noted that the second curve 25 is located above the first curve 15, which means that under a fatigue loading at a loading level C, steel specimens produced in accordance with the invention break on average at a higher number N of cycles than that at which the prior art steel specimens break.

In addition, the distance between the two curves 26 and 24 shown as thick dashed lines is smaller than the distance between the two curves 16 and 14 shown as thin dashed lines, which means that the fatigue behavior dispersion of the steel produced in accordance with the invention is smaller than that of a prior art steel.

FIG. 1 illustrates the experimental results summarized in Table 1 below.

Table 1 gives the results for oligocyclic fatigue loading in accordance with FIG. 2 with a zero minimum stress $C_{min}$, at a temperature of 250° C., with N=20000 cycles, and N=50000 cycles. "Oligocyclic fatigue" means that the loading frequency is of the order of 1 Hz (the frequency being defined as the number of periods T per second).

TABLE 1

| Oligocyclic fatigue test conditions | | Prior art steel | | Steel produced in accordance with invention | |
|---|---|---|---|---|---|
| N | Temperature | $C_{min}$ | Dispersion | $C_{min}$ | Dispersion |
| $2 \times 10^5$ | 200° C. | 100% = M | 120% M | 130% M | 44% M |
| $5 \times 10^4$ | 400° C. | 100% = M | 143% M | 130% M | 90% M |

It should be noted that for a given value of the number of cycles N, the minimum fatigue loading value necessary to break a steel of the invention is higher than the minimum value M for the fatigue loading (fixed at 100%) necessary to break a prior art steel. The dispersion (=6σ) for the results at this number N of cycles for a steel of the invention is smaller than the dispersion for the results for a prior art steel (dispersions expressed as a percentage of the minimum value M).

Advantageously, the carbon content of the stainless martensitic steel is lower than the carbon content below which the steel is hypoeutectoid, for example a content of 0.49%. In fact, a low carbon content allows better diffusion of the alloying elements and a reduction in the solution temperatures for primary or noble carbides, which results in better homogenization.

Before electroslag remelting, a martensitic steel, for example, will have been produced in air.

The invention claimed is:

1. A method of fabricating a stainless martensitic steel, comprising:

electroslag remelting of an ingot of said steel;

cooling said ingot;

placing the cooled ingot from electroslag remelting in a furnace before a temperature of a skin of said ingot falls below a martensitic transformation temperature Ms of the steel, an initial temperature $T_0$ of the furnace being greater than a pearlite transformation completion temperature on cooling, Ar1, of said steel; and homogenization treating said ingot in said furnace for at least a holding time t after which a temperature of a coldest point of said ingot has reached a homogenization temperature T, said holding time t being equal to at least one hour, with the homogenization temperature T being in the range approximately 900° C. to a burning temperature of said steel.

2. The method of fabricating a stainless martensitic steel according to claim 1, wherein said initial temperature $T_0$ of the furnace is lower than said homogenization temperature T, the temperature of the furnace being increased from its initial temperature $T_0$ to a temperature at least equal to the homogenization temperature T.

3. The method of fabricating a stainless martensitic steel according to claim 1, wherein the homogenization temperature T is in the range selected from the group comprising the following ranges: 950° C. to 1270° C., 980° C. to 1250° C., and 1000° C. to 1200° C.

4. The method of fabricating a stainless martensitic steel according to claim 1, wherein the minimum holding time is in a range selected from the following ranges: 1 hour to 70 hours, 10 hours to 30 hours, and 30 hours to 150 hours.

5. The method of fabricating a stainless martensitic steel according to claim 1, wherein the slag used in said remelting step has been dehydrated in advance.

6. The method of fabricating a stainless martensitic steel according to claim 1, wherein said holding time t varies inversely with a variation in said homogenization temperature T.

7. The method of fabricating a stainless martensitic steel according to claim 1, wherein the method is carried out on said steel in one of the following circumstances:

a maximum dimension of said ingot before cooling is less than approximately 910 mm, and an H content of the ingot before electroslag remelting is more than 10 ppm;

the maximum dimension of said ingot before cooling is more than approximately 910 mm and its minimum dimension is less than approximately 1500 mm, and the H content of the ingot before electroslag remelting is more than 3 ppm;

the minimum dimension of the ingot is more than 1500 mm and the H content of the ingot before electroslag remelting is more than 10 ppm.

8. The method of fabricating a stainless martensitic steel according to claim 1, wherein a carbon content of said steel is less than the carbon content below which the steel is hypoeutectoid.

* * * * *